US010364635B2

(12) United States Patent
Puccio et al.

(10) Patent No.: US 10,364,635 B2
(45) Date of Patent: Jul. 30, 2019

(54) ADJUSTABLE ISOLATION SLEEVE

(71) Applicant: Cameron International Corporation, Houston, TX (US)

(72) Inventors: William F. Puccio, Katy, TX (US); Shian Jiun Chou, Houston, TX (US); David Cain, Katy, TX (US)

(73) Assignee: Cameron International Corporation, Houston, TX (US)

( * ) Notice: Subject to any disclaimer, the term of this patent is extended or adjusted under 35 U.S.C. 154(b) by 908 days.

(21) Appl. No.: 14/528,992

(22) Filed: Oct. 30, 2014

(65) Prior Publication Data

US 2016/0123103 A1 May 5, 2016

(51) Int. Cl.
*E21B 33/038* (2006.01)
*E21B 33/03* (2006.01)

(52) U.S. Cl.
CPC ..... *E21B 33/03* (2013.01); *E21B 33/038* (2013.01)

(58) Field of Classification Search
CPC ..... E21B 33/03; E21B 33/038
See application file for complete search history.

(56) References Cited

U.S. PATENT DOCUMENTS 2,126,857 A * 8/1938 Yancey ..... E21B 33/03 285/32
2,909,045 A * 10/1959 Burns ..... B21B 35/141 464/156
3,721,292 A * 3/1973 Ahlstone ..... E21B 17/01 166/208
5,465,788 A 11/1995 Wright
6,039,120 A 3/2000 Wilkins
9,447,671 B2 * 9/2016 Nguyen ..... E21B 43/26
2003/0205385 A1 * 11/2003 Duhn ..... E21B 33/03 166/380
2003/0209857 A1 * 11/2003 Keene ..... E21B 33/03 277/336
2013/0126181 A1 5/2013 Bell
2013/0175039 A1 7/2013 Guidry
2013/0175054 A1 7/2013 Hart et al.
2013/0175055 A1 7/2013 Hart et al.

OTHER PUBLICATIONS

International Search Report and Written Opinion for the equivalent International patent application PCT/US2015/056140 dated Jan. 26, 2016.

* cited by examiner

*Primary Examiner* — Cathleen R Hutchins
*Assistant Examiner* — Ronald R Runyan
(74) *Attorney, Agent, or Firm* — Helene Raybaud

(57) ABSTRACT

A system for coupling to equipment at a well includes a connector and/or an outer sleeve sub engageable with the connector, each including an internal bore. An isolation sleeve includes a seal and is positioned at least partially within the internal bore, in which the seal is axially movable with respect to the internal bore so as to be positionable to seal against the equipment.

13 Claims, 6 Drawing Sheets

ADJUSTABLE ISOLATION SLEEVE

BACKGROUND

This section is intended to introduce the reader to various aspects of art that may be related to various aspects of the presently described embodiments. This discussion is believed to be helpful in providing the reader with background information to facilitate a better understanding of the various aspects of the present embodiments. Accordingly, it should be understood that these statements are to be read in this light, and not as admissions of prior art.

In order to meet consumer and industrial demand for natural resources, companies often invest significant amounts of time and money searching for and extracting oil, natural gas, and other subterranean resources from the earth. Particularly, once a desired subterranean resource is discovered, drilling and production systems are often employed to access and extract the resource. These systems may be located onshore or offshore depending on the location of a desired resource. Further, such systems generally include a wellhead assembly through which the resource is extracted. These wellhead assemblies may include a wide variety of components, such as various casings, valves, fluid conduits, and the like, that control drilling or extraction operations.

More particularly, wellhead assemblies typically include and connect to pressure-control equipment, such as a blowout preventer, to help control the flow of fluid (e.g., oil or natural gas) from a well. As will be appreciated, uncontrolled releases of oil or gas from a well via the wellhead assembly (also referred to as a blowout) are undesirable. Further, components and equipment in use with and coupled to the wellhead assembly must be robust, otherwise oil or gas may be unintentionally released through these other components. As such, as there are numerous manufacturers for these components and equipment, in addition to the wellhead assemblies and blowout preventers themselves, measures must be taken to ensure that all of the equipment in use and the connections between the equipment are robust and field ready.

BRIEF DESCRIPTION OF THE DRAWINGS

For a detailed description of the preferred embodiments of the present disclosure, reference will now be made to the accompanying drawings in which.

DETAILED DESCRIPTION

Figure 1:
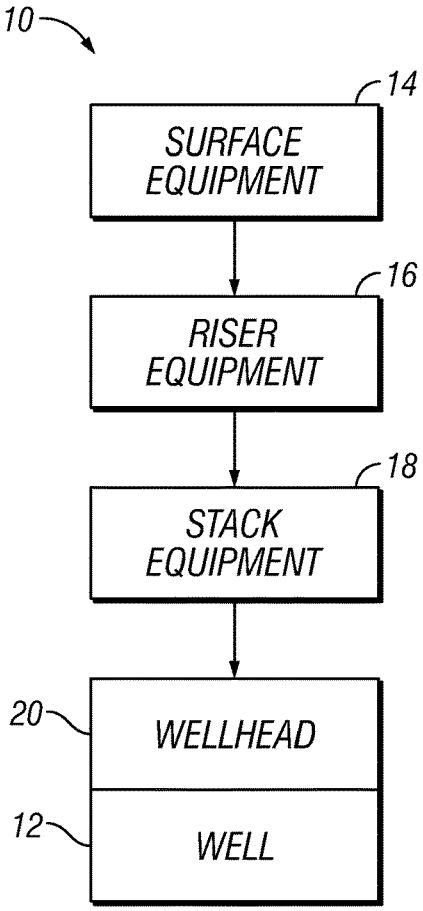
FIG. 1 shows a block diagram of a resource extraction system in accordance with one or more embodiments of the present disclosure.

The following discussion is directed to various embodiments of the present disclosure. The drawing figures are not necessarily to scale. Certain features of the embodiments may be shown exaggerated in scale or in somewhat schematic form and some details of conventional elements may not be shown in the interest of clarity and conciseness. Although one or more of these embodiments may be preferred, the embodiments disclosed should not be interpreted, or otherwise used, as limiting the scope of the disclosure, including the claims. It is to be fully recognized that the different teachings of the embodiments discussed below may be employed separately or in any suitable combination to produce desired results. In addition, one skilled in the art will understand that the following description has broad application, and the discussion of any embodiment is meant only to be exemplary of that embodiment, and not intended to intimate that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but are the same structure or function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. In addition, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis. The use of "top," "bottom," "above," "below," and variations of these terms is made for convenience, but does not require any particular orientation of the components.

Reference throughout this specification to "one embodiment," "an embodiment," or similar language means that a particular feature, structure, or characteristic described in connection with the embodiment may be included in at least one embodiment of the present disclosure. Thus, appearances of the phrases "in one embodiment," "in an embodiment," and similar language throughout this specification may, but do not necessarily, all refer to the same embodiment.

Turning now to the present figures, a resource extraction system 10 is illustrated in FIG. 1 in accordance with one or more embodiments of the present disclosure. Notably, the system 10 facilitates extraction of a resource, such as oil or natural gas, from a well 12. As depicted, the system 10 may be a subsea system that includes surface equipment 14, riser equipment 16, and/or stack equipment 18, for extracting the resource from the well 12 via a wellhead 20. In one subsea resource extraction application, the surface equipment 14 may be mounted to a drilling rig above the surface of the water, the stack equipment 18 may be coupled to the wellhead 20 near the sea floor, and the surface equipment 14 and the stack equipment 18 may be coupled to one another via the riser equipment 16.

As will be appreciated, the surface equipment 14 may include a variety of devices and systems, such as pumps, power supplies, cable and hose reels, control units, a diverter, a gimbal, a spider, and the like. Similarly, the riser equipment 16 may also include a variety of components, such as riser joints, fill valves, control units, and a pressure-temperature transducer, to name but a few. The riser equipment 16 may facilitate transmission of the extracted resource to the surface equipment 14 from the stack equipment 18 and the well 12. The stack equipment 18, in turn, may include a number of components, such as blowout preventers, production trees (also known as "Christmas" trees), and the like for extracting the desired resource from the wellhead 20 and transmitting the resource to the surface equipment 14 via the riser equipment 16.

Figure 2:
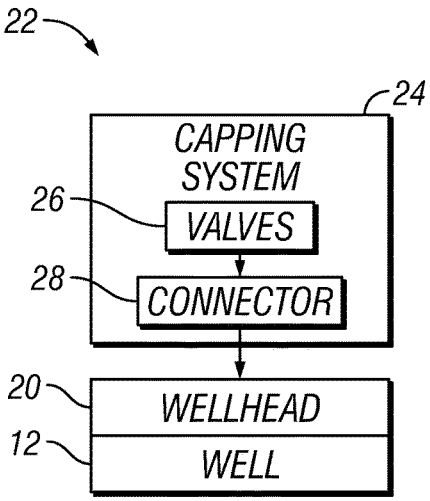
FIG. 2 generally shows a coupling of a well capping system to a wellhead in accordance with one or more embodiments of the present disclosure.
Figure 3:
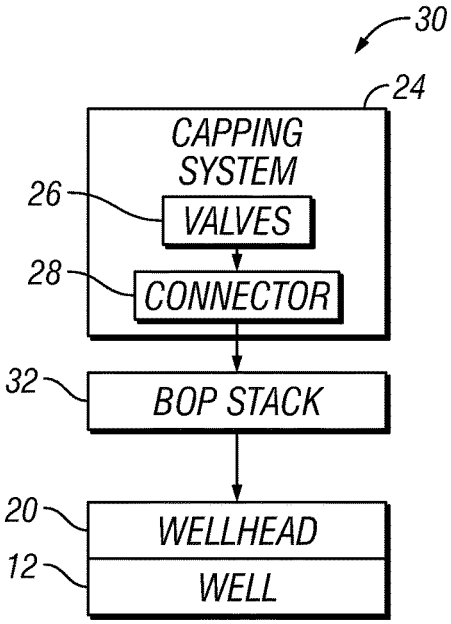
FIG. 3 generally shows a coupling of the well capping system to a blowout preventer stack installed on a wellhead in accordance with one or more embodiments of the present disclosure.

In one or more embodiments, if a blowout occurs at a well, a capping system may be used in some instances to seal the well and reestablish control. Examples of the use of such capping systems are provided in FIGS. 2 and 3. In one embodiment of the present disclosure represented by a block diagram 22 in FIG. 2, a capping system 24 may be attached to the wellhead 20 (such as following removal of the stack equipment 18 from the wellhead 20). The capping system 24 may include one or more valves 26, such as a blowout preventer, for controlling flow from the wellhead 20. The capping system 24 may also include an adapter or connector 28 that facilitates connection of the capping system 24 onto the wellhead 20.

In one or more embodiments, the connector 28 may also facilitate connection of the capping system 24 onto other equipment installed at a well. For instance, in the embodiment generally represented by a block diagram 30 in FIG. 3, the capping system 24 may be attached to a blowout preventer stack 32 via the connector 28. When not in use, the capping system 24 may be kept on "stand-by" as safety equipment for responding to a blowout. And though the capping system 24 may be used with subsea well installations, it is noted that the capping system 24 may also be used with other well installations (e.g., equipment of surface wells).

Figure 4:
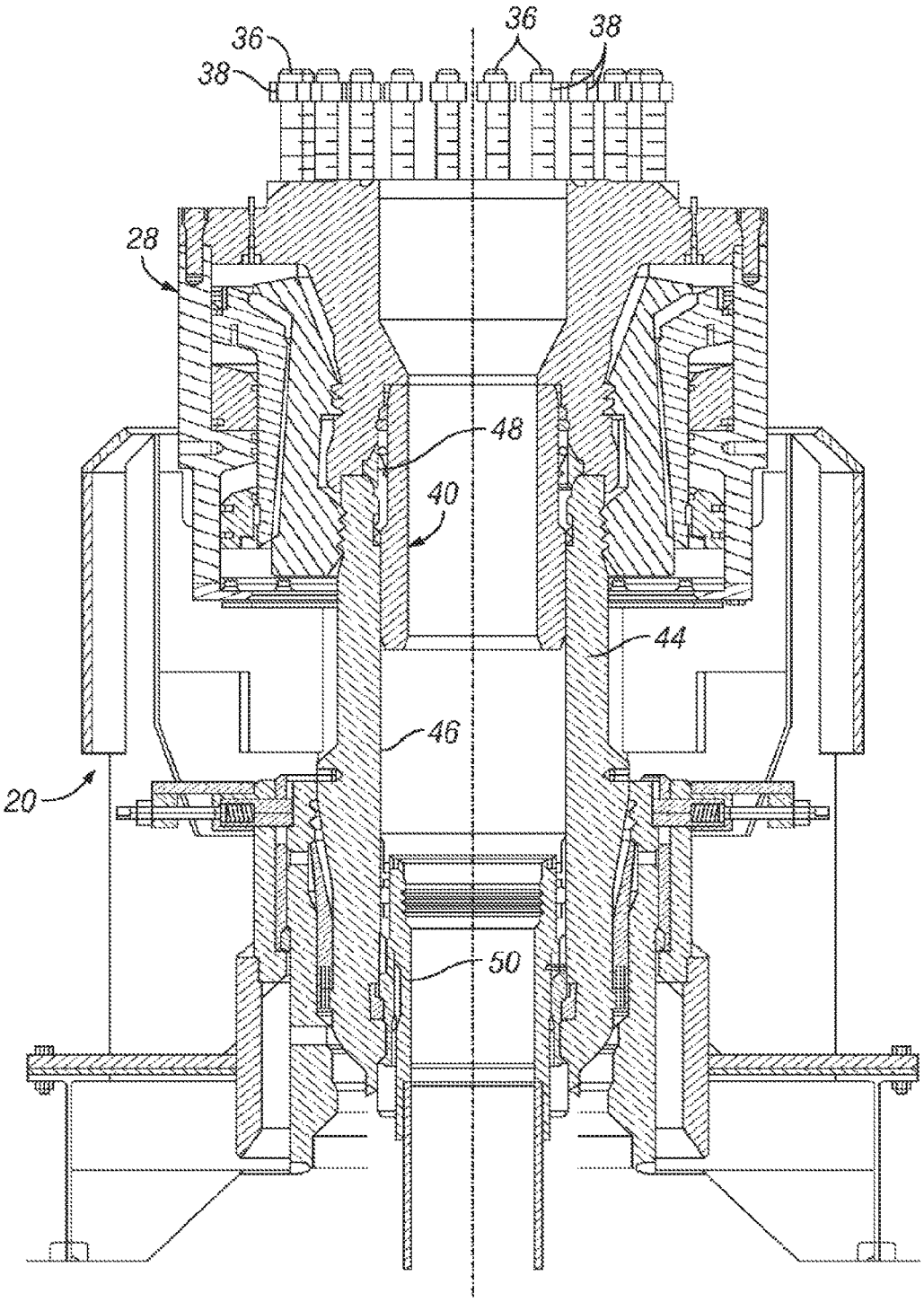
FIG. 4 shows a cross-section of a connector with an isolation sleeve connected to a wellhead component in accordance with one or more embodiments of the present disclosure.

Additional features relating to the connector 28 and the connection to other equipment installed at the well 12, in accordance with one embodiment, are depicted in FIG. 4. The connector 28 is illustrated in this figure as connected to the wellhead 20 (as in FIG. 2), though those having ordinary skill in the art will appreciate that the connector 28 may be connected to other equipment as well, including the blowout preventer stack 32 of FIG. 3.

The connector 28 may include studs 36 and nuts 38 at one end for coupling the connector 28 to other components (e.g., components of the capping system 24). Further, an isolation sleeve 40 may be retained in an opposite end of the connector 28. The connector 28 and the isolation sleeve 40 may be aligned with a desired component of equipment installed at the well 12. The connector 28 may be moved to insert the isolation sleeve 40 into a bore of the desired component and the connector 28 may be secured to the component. For example, as shown in FIG. 4, the connector 28 may be clamped onto a housing component 44 of the wellhead 20 having a bore 46 that receives the isolation sleeve 40. Further, in one or more embodiments, the isolation sleeve 40 may be inserted within a bore of a tubing hanger 50 or other component disposed in the wellhead.

The isolation sleeve 40 may be used with other equipment (e.g., the isolation sleeve 40 may be inserted into a bore of a component of the blowout preventer stack 32 or within the bore of the housing component 44), as opposed to being limited to the various configurations and arrangements shown in FIGS. 1-4. For instance, the length of an isolation sleeve 40 dimensions and/or configurations for the isolation sleeve 40 may be varied or may differ between embodiments to correspond to areas to be sealed by the isolation sleeves 40, or the diameter of the isolation sleeve 40 may differ between embodiments according to the bore sizes of the components in which the isolation sleeve 40 is to be installed. By way of further example, the connector 28 may be an 18¾ inch H4-style connector, the housing component 44 may be an 18¾ inch H4 profile wellhead housing, and the isolation sleeve 40 may be an 18¾ inch isolation sleeve.

A gasket 48 may be provided at the interface between the end of the housing component 44 and the connector 28. In one or more embodiments, the gasket 48 may be a high-performance metal-to-metal sealing ring. In some instances, the gasket 48 may be sufficient to seal the interface between the housing component 44 and the connector 28. Further, in other instances, such as during a blowout, the end of the housing component 44 may be damaged in a manner that prevents the gasket 48 from adequately sealing the connection between the component 44 and the connector 28. In such cases, the isolation sleeve 40 may provide additional sealing to inhibit fluid leakage from between the housing component 44 and the connector 28. While the isolation sleeve 40 is described below in the context of a connector and capping system, the isolation sleeve 40 may also be used in other contexts. For example, the isolation sleeve 40 may be used as an alternative to a more conventional isolation sleeve used in a horizontal, dual-bore subsea Christmas tree or between other wellhead assembly components.

Accordingly, disclosed herein are an isolation sleeve and a system incorporating an isolation sleeve, to provide a sealing barrier, such as when coupling to equipment at a well. The system may include a connector to couple to equipment installed at the well, in which the isolation sleeve is positioned at least partially within an internal bore of the connector and is axially movable with respect to the internal bore of the connector. Additionally or alternatively, the system may include an outer sleeve sub, in which the isolation sleeve is positioned at least partially within an internal bore of the outer sleeve sub and is axially movable with respect to the internal bore of the outer sleeve sub. The outer sleeve sub may then be positioned within and coupled to the internal bore of the connector. Further, a nut may be coupled to the isolation sleeve to secure the isolation sleeve within the internal bore of the connector and/or the outer sleeve sub. The nut and the isolation sleeve may then be threadedly engaged with each other such that rotation of the nut and isolation sleeve with respect to each other moves the isolation sleeve within the internal bore(s).

Figure 5:
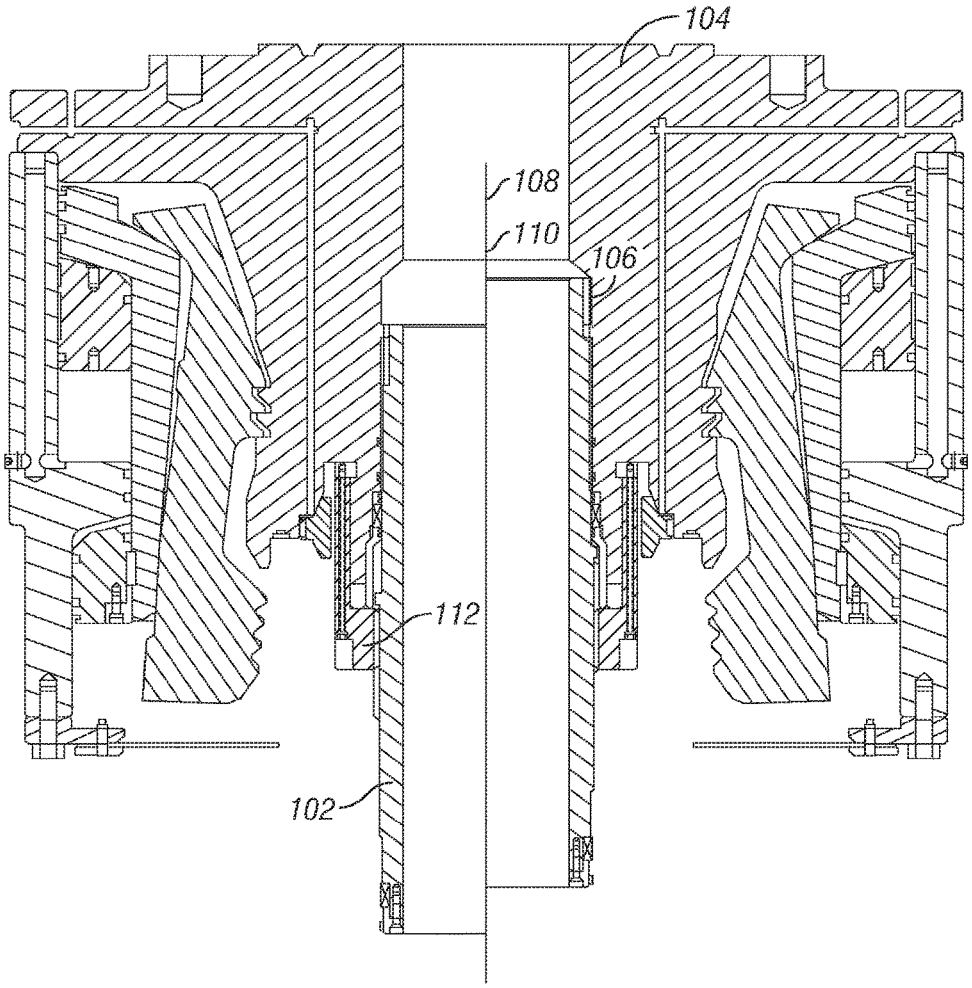
FIG. 5 shows a cross-section of a connector with an isolation sleeve in accordance with one or more embodiments of the present disclosure.
Figure 6:
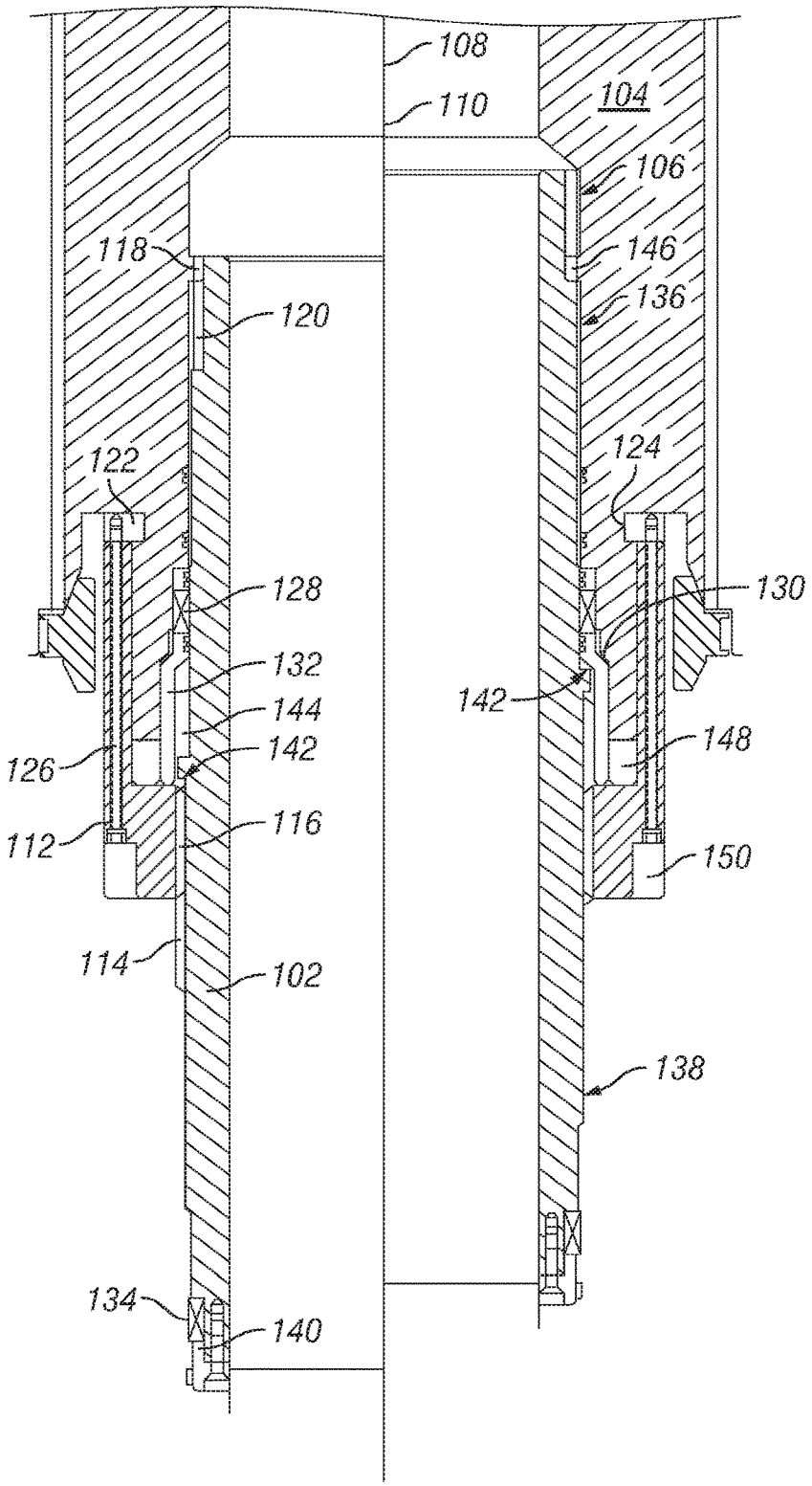
FIG. 6 shows a detailed view of the connector and isolation sleeve shown in FIG. 5 in accordance with one or more embodiments of the present disclosure.

Referring now to FIGS. 5 and 6, multiple cross-sectional views of an isolation sleeve 102 within a connector 104 in accordance with one or more embodiments of the present disclosure are shown. In particular, FIG. 5 shows a cross-sectional view of the isolation sleeve 102 positioned and received, at least partially, within an internal bore 106 of the connector 104, and FIG. 6 shows a more detailed view of the isolation sleeve 102.

The isolation sleeve 102 is axially movable with respect to the internal bore 106 of the connector 104. In particular, the internal bore 106 of the connector 104 may have an axis 108 defined therethrough, and the isolation sleeve 102 may also have an axis 110 defined therethrough, in which the axis 110 of the isolation sleeve 102 may be collinear with the axis 108 of the connector 104. As such, with the isolation sleeve 102 axially movable within and with respect to the internal bore 106 of the connector 104, the isolation sleeve 102 may move back and forth along the axis 108 of the internal bore 106. Accordingly, the left side of FIGS. 5 and 6 show the isolation sleeve 102 in a lower position with respect to the internal bore 106 of the connector 104, and the right side of FIGS. 5 and 6 show the isolation sleeve 102 in an upper position with respect to the internal bore 106 of the connector 104.

In one or more embodiments, a nut 112, or some other type of securing mechanism, may be included and used to secure the isolation sleeve 102 within the internal bore 106 of the connector 104. The nut 112 and the isolation sleeve 102 may be threadedly engaged with each other, such as by the isolation sleeve 102 having a thread 114 formed on the outer surface thereof to engage with a thread 116 formed on an internal surface of the nut 112. Rotation of the isolation sleeve 102 with respect to the nut 112 may move the isolation sleeve 102 with respect to the nut 112, and therefore this rotation may move the isolation sleeve 102 axially within the internal bore 106 of the connector 104.

Further, in one or more embodiments, the isolation sleeve 102 may be prevented from rotating (i.e., rotational movement) within or with respect to the internal bore 106 of the connector 104. In one embodiment, a key 118 and a keyway 120 may be used to prevent rotational movement of the isolation sleeve 102 with respect to the internal bore 106 of the connector 104. The key 118, which is shown as formed within the internal bore 106 of the connector 104 in this embodiment, may engage with and be slotted within the keyway 120, which is shown as formed on the external surface of the isolation sleeve 102 in this embodiment, thereby preventing rotation of the isolation sleeve 102 within the internal bore 106 of the connector 104. As such, as the isolation sleeve 102 may be rotationally constrained within the internal bore 106 of the connector 104, this may facilitate axial movement of the isolation sleeve 102 within and with respect to the internal bore 106 of the connector 104 when the nut 112 is rotated with respect to the isolation sleeve 102. It should be appreciated that other means or elements for preventing relative rotation may also be used.

Referring still to FIGS. 5 and 6, the nut 112 may be secured to the connector 104, such as by securing the nut 112 to a ring 122, thereby securing the isolation sleeve 102 within the internal bore 106 of the connector 104. The connector 104 may have a notch 124 or a shoulder formed internally therein and positioned radially outward from the internal bore 106, in which the ring 122 may be positioned and secured within the notch 124. In one or more embodiments, the ring 122 may be a split-ring to position the ring 122 within the notch 124. Further, the nut 112 may be secured to the ring 122 using pins 126, bolts, screws, or some other type of securing mechanism.

Those having ordinary skill in the art will appreciate that, though a nut is shown to secure and axially move the isolation sleeve within the internal bore of the connector, the present disclosure is not so limited. For example, other types of mechanisms and engagements, besides a nut with threaded engagement, may be used to axially move the isolation sleeve within the internal bore of the connector. For example, multiple notches may be formed between the isolation sleeve and the internal bore of the connector, in which a key may engage with a selected notch to secure the isolation sleeve within a desired position within the internal bore of the connector. Additionally or alternatively, a pin may be inserted through and secured into a hole between the isolation sleeve and the internal bore of the connector to secure the isolation sleeve within a desired position within the internal bore of the connector. Accordingly, other configurations and arrangements may be used to axially move and secure the isolation sleeve within the internal bore of the connector without departing from the scope of the present disclosure.

One or more seals may be to seal between or against the isolation sleeve 102. For example, a first seal 128, which may be a metal end cap seal, may be positioned between the internal bore 106 of the connector 104 and the isolation sleeve 102 to seal between and against the connector 104 and the isolation sleeve 102. In this embodiment, a channel or groove 130 may be formed between or within one of the internal bore 106 of the connector 104 and the isolation sleeve 102, in which the first seal 128 may be positioned within the groove 130. A seal support 132 may then be positioned adjacent the first seal 128 to support the first seal 128 within the groove 130 and against the isolation sleeve 102.

Further, a second seal 134, which may also be a metal end cap seal, may be positioned on the isolation sleeve 102 to seal against other equipment, such as seal against an internal bore of a blowout preventer, a wellhead component, and/or a tubing hanger. As shown in FIGS. 5 and 6, the isolation sleeve 102 may include one end 136 (e.g., an upper end) that is positioned within the connector 104, and may include another end 138 (e.g., a lower end) that extends out from the connector 104. Accordingly, the second seal 134 may be positioned on the end 138 to seal between the isolation sleeve 102 and an internal bore of equipment coupled to the connector 104. Furthermore, in this embodiment, a second seal support 140, such as a bushing or bracket, may be coupled to the isolation sleeve 102 at the end 138 and positioned adjacent the second seal 134 to support the second seal 134 against the isolation sleeve 102.

In accordance with one or more embodiments of the present disclosure, one or more stops may be used to limit the axial movement of the isolation sleeve 102 within and with respect to the internal bore 106 of the connector 104. For example, one or more shoulders may be formed on or between the isolation sleeve 102 and the internal bore 106 of the connector 104 to limit upward axial movement and/or downward axial movement of the isolation sleeve 102 with respect to the internal bore 106 of the connector 104.

In FIGS. 5 and 6, a shoulder 142 may be used to limit upward and/or downward axial movement of the isolation sleeve 102 with respect to the internal bore 106 of the connector 104. The shoulder 142 may be formed on or extend from the isolation sleeve 102 in this embodiment, in which the shoulder 142 may act as a lower stop (e.g., lower shoulder) to engage against the nut 112 to prevent downward axial movement of the isolation sleeve 102 past a predetermined amount with respect to the internal bore 106 of the connector 104. Further, the shoulder 142 may act as an upper stop (e.g., upper shoulder) to engage against the seal support 132 to prevent upward axial movement of the isolation sleeve 102 past a predetermined amount with respect to the internal bore 106 of the connector 104. As shown, a clearance 144 may be formed between the internal bore 106 of the connector 104 and the isolation sleeve 102 and adjacent the shoulder 142 to facilitate and determine a desired amount of movement of the shoulder 142, and therefore of the isolation sleeve 102, within and with respect to the internal bore 106 of the connector 104. Furthermore, in one or more embodiments, a second shoulder 146, which may be the same or similar to the key 118 and the keyway 120, may be used to limit upward and/or downward axial movement of the isolation sleeve 102 with respect to the internal bore 106 of the connector 104. In the embodiment shown in FIGS. 5 and 6, the second shoulder 146 may act as an upper stop to prevent upward axial movement of the isolation sleeve 102 past a predetermined amount with respect to the internal bore 106 of the connector 104.

Referring still to FIGS. 5 and 6, one or more notches and grooves or castellated interfaces may be formed on the connector 104 and/or the nut 112 to facilitate movement and/or a secured fit of the connector 104 with the nut 112. For example, a castellated interface 148 may be formed between a lower surface of the connector 104 and an upper surface of the nut 112, if desired, to facilitate engagement between the connector 104 and the nut 112, such as to prevent undesired rotational movement of the nut 112 with respect to the connector 104. Furthermore, the nut 112 may have a castellated interface 150 formed on a bottom surface thereof, such as to facilitate rotation and torqueing of the nut 112.

Figure 7:
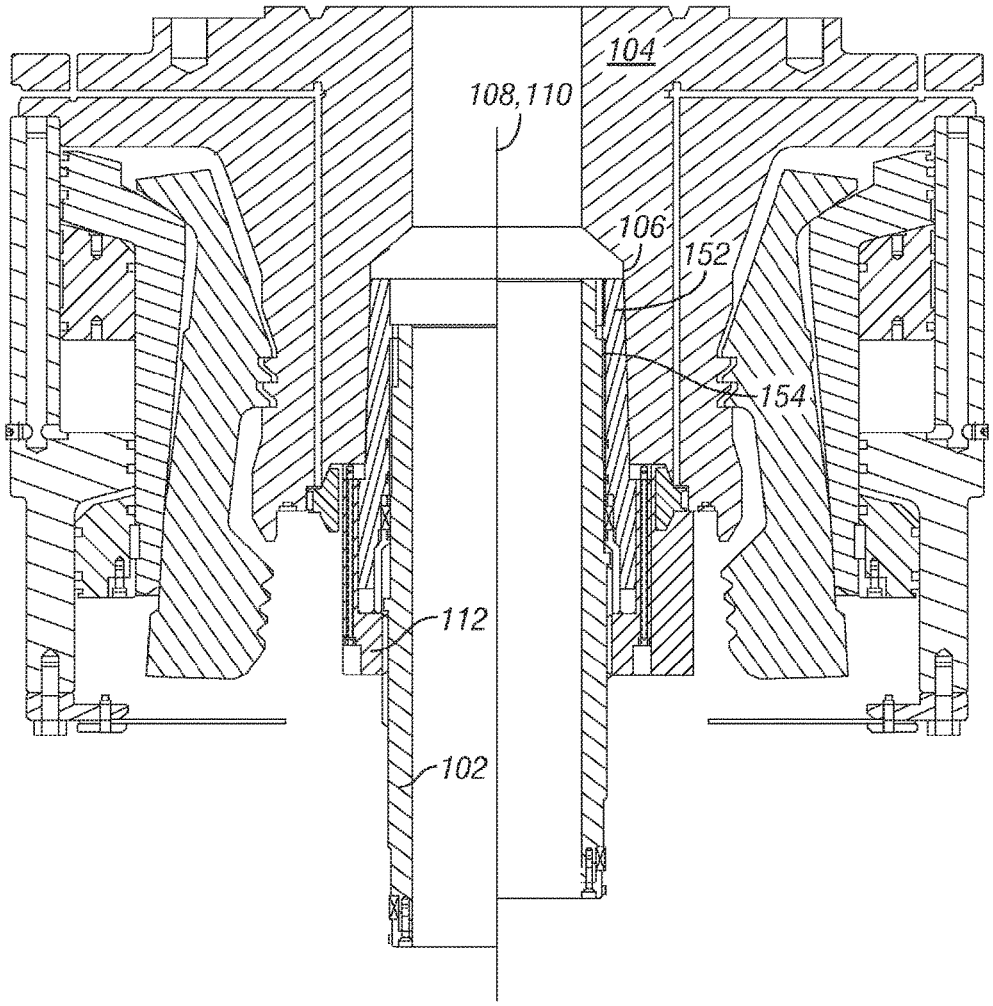
FIG. 7 shows a cross-section of a connector with an isolation sleeve and an outer sleeve sub in accordance with one or more embodiments of the present disclosure.
Figure 8:
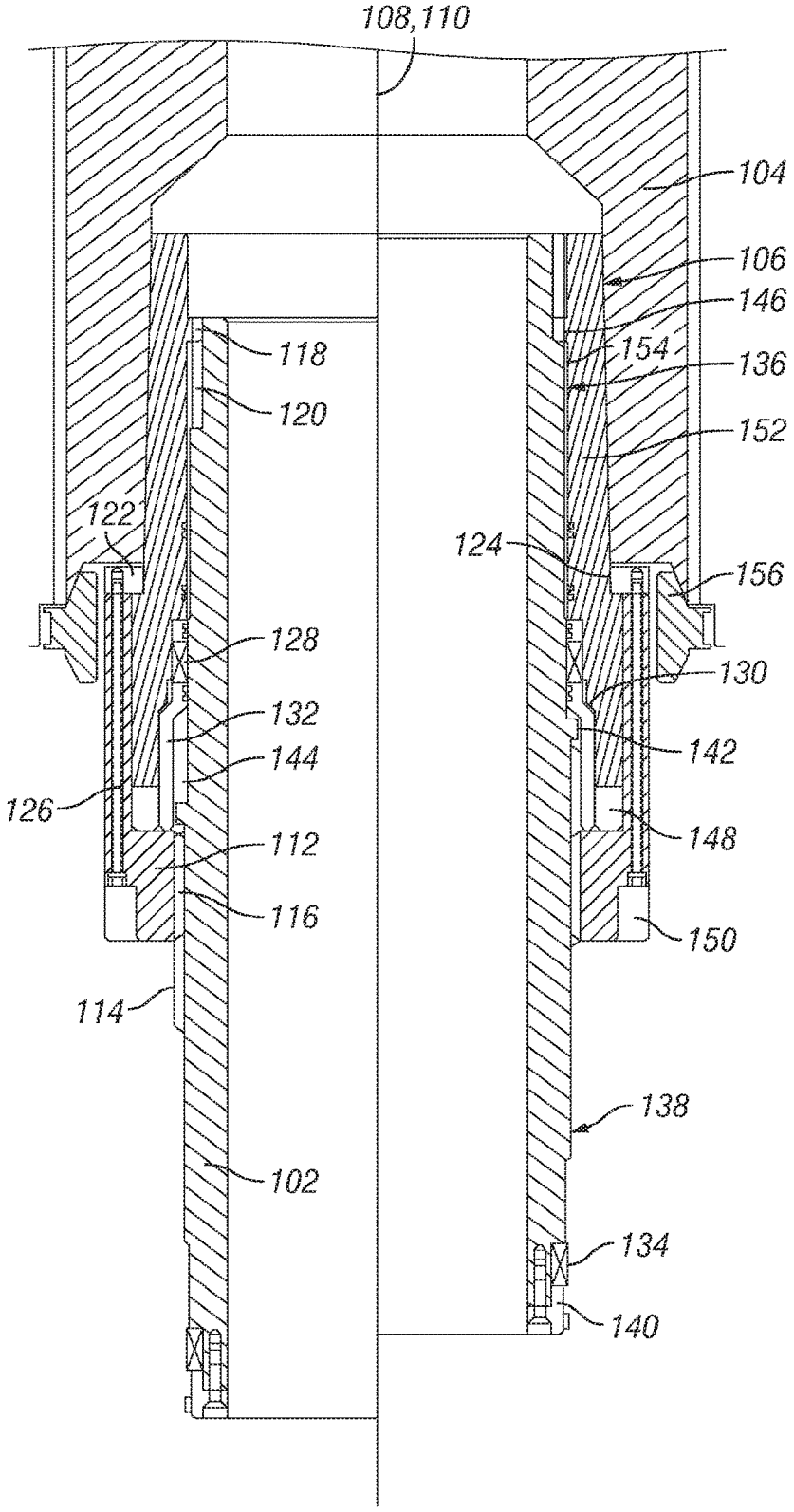
FIG. 8 shows a detailed view of the connector, isolation sleeve, and outer sleeve sub shown in FIG. 7 in accordance with one or more embodiments of the present disclosure.

Referring now to FIGS. 7 and 8, multiple cross-sectional views of the isolation sleeve 102 within the connector 104 in accordance with one or more embodiments of the present disclosure are shown. In this embodiment, an outer sleeve sub 152 may be included and positioned, at least partially, within the internal bore 106 of the connector 104. The isolation sleeve 102 may then positioned, at least partially, within an internal bore 154 of the outer sleeve sub 152, in which the isolation sleeve 102 may be axially movable with respect to the internal bore 106 of the connector 104 and/or the internal bore 154 of the outer sleeve sub 152. As such, in one or more embodiments, the outer sleeve sub 152 may be coupled and threadedly engaged within the internal bore 106 of the connector 104.

The embodiment shown in FIGS. 7 and 8 may be similar to the embodiment shown in FIGS. 5 and 6, except with the inclusion of the outer sleeve sub 152 within the embodiment of FIGS. 7 and 8. For example, the nut 112 may be coupled to the outer sleeve sub 152 in FIGS. 7 and 8 to secure the isolation sleeve 102 within the outer sleeve sub 152, in which rotation of the isolation sleeve 102 with respect to the nut 112 moves the isolation sleeve axially within the internal bore 154 of the outer sleeve sub 152. The nut 112 may then be secured to the out sleeve sub 152, such as by having the notch 124 formed on an outer surface of the outer sleeve sub 152 with the ring 122 positioned within the notch 124. Further, as one having ordinary skill in the art would appreciate, the key 118 and the keyway 120 may be formed between the outer sleeve sub 154 and the isolation sleeve 102 in the embodiment in which the outer sleeve sub 154 is present. Furthermore, the first seal 128 and the seal support 132 may be positioned between the outer sleeve sub 152 and the isolation sleeve 102 to seal therebetween. Accordingly, one having ordinary skill in the art will appreciate that the outer sleeve sub 152 may be used similarly to the connector 104, such as by the internal bore 154 of the outer sleeve sub 102 having similar functionality and features as the internal bore 106 of the connector 104 in FIGS. 5 and 6. The outer sleeve sub 152 may then be used in one or more embodiments, such as when retro-fitting existing connectors 104 with the isolation sleeve 102 to be axially movable therein.

A method of assembling a system in accordance with the present disclosure, with respect to the embodiment of the system shown in FIGS. 5 and 6, may include inserting the first seal 128 and the seal support 132 within the groove 130 and/or about the outer surface of the isolation sleeve 102. The isolation sleeve 102 may then be positioned within the connector 104, such as by establishing engagement between the key 118 and the keyway 120. The nut 112 may be threadedly engaged with the isolation sleeve 102 such that the isolation sleeve 102 is at a desired axial position with respect to the connector 104, in which the nut 112 may be secured in position by coupling with the ring 122. A gasket 156 may then be positioned at a bottom surface of the connector 104 to provide a seal when the connector 104 couples to and connects to other equipment, such as at a well. In an embodiment in which the system includes the outer sleeve sub 152, the outer sleeve sub 152 may first be coupled and/or rotationally engaged within the internal bore 106 of the connector 104, with the steps discussed above then following. Alternatively, the first seal 128 and the isolation sleeve 102 may be positioned and secured within the outer sleeve sub 152, with the outer sleeve sub 152 then later being coupled and/or rotationally engaged within the internal bore 106 of the connector 104.

In one or more embodiments, a system and an isolation sleeve in accordance with the present disclosure may enable the isolation sleeve to be axially movable, thereby enabling the isolation sleeve to effectively seal between an internal bore of the connector with an internal bore of equipment connected to the connector. For example, a connector with an isolation sleeve may be used to couple to equipment at a well, such as a blowout preventer, a wellhead component, a tubing hanger, and/or other types of equipment. As the shapes and sizes change amongst these various types of equipment, the axial position of the isolation sleeve may adjust to effectively seal within an internal bore of the equipment. Further, an outer sleeve sub may be used within one or more embodiments, such as to retrofit a connector with an axially movable isolation sleeve.

While the aspects of the present disclosure may be susceptible to various modifications and alternative forms, specific embodiments have been shown by way of example in the drawings and have been described in detail herein. But it should be understood that the invention is not intended to be limited to the particular forms disclosed. Rather, the invention is to cover all modifications, equivalents, and alternatives falling within the spirit and scope of the invention as defined by the following appended claims.

What is claimed is:

1. A system for coupling to well equipment, comprising:

a connector to couple to the well equipment, the connector comprising an internal bore; and an isolation sleeve positioned at least partially within the internal bore of the connector and comprising a seal, the isolation sleeve and the seal axially movable together with respect to the internal bore of the connector so as to be positionable to extend into and engage the well equipment;

a nut coupled to the connector to secure the isolation sleeve within the internal bore of the connector; and an outer sleeve sub positioned at least partially within the internal bore of the connector with the isolation sleeve positioned at least partially within the outer sleeve sub, the isolation sleeve axially movable with respect to the outer sleeve sub;

wherein the isolation sleeve and the nut are engaged with each other such that rotation of the nut with respect to the isolation sleeve moves the isolation sleeve and the seal axially with respect to the internal bore of the connector; and wherein the nut is coupled to the outer sleeve sub and capable of securing the isolation sleeve within the outer sleeve sub.

2. The system of claim 1, further comprising:

a ring coupled with the nut to secure the nut to the connector.

3. The system of claim 1, wherein the nut and the outer sleeve sub comprise a castellated interface.

4. The system of claim 1, further comprising:

a shoulder to limit the axial movement of the isolation sleeve with respect to the internal bore of the connector; and wherein the shoulder comprises at least one of an upper shoulder to limit upward axial movement of the isolation sleeve with respect to the internal bore of the connector and a lower shoulder to limit downward axial movement of the isolation sleeve with respect to the internal bore of the connector.

5. The system of claim 1, further comprising:

a keyway included on an external surface of the isolation sleeve; and a key included within the internal bore of the connector and engageable with the keyway to prevent rotational movement of the isolation sleeve with respect to the internal bore of the connector.

6. The system of claim 1, further comprising:

a second seal to engage against an outer surface of the isolation sleeve; and a seal support positioned adjacent the second seal to support the second seal against the isolation sleeve;

wherein the second seal comprises a metal end cap seal.

7. The system of claim 1, further comprising the well equipment installed at the well, wherein the well equipment comprises at least one of a blowout preventer, a wellhead component, and a tubing hanger.

8. The system of claim 1, wherein the well equipment comprises well equipment with a plurality of internal bores of different configurations, wherein the isolation sleeve is axially movable with respect to the internal bore of the connector so as to be positionable to extend into and engage against the plurality of different internal bores of the well equipment.

9. A system for a connector connectable to well equipment, comprising:

an outer sleeve sub configured to be positioned at least partially within and engageable with the connector, the outer sleeve sub comprising an internal bore;

an isolation sleeve positioned at least partially within the internal bore of the outer sleeve sub and comprising a seal, the isolation sleeve and the seal axially movable with respect to the internal bore of the outer sleeve sub so as to be positionable to engage the well equipment; and a nut coupled to the outer sleeve sub to secure the isolation sleeve within the internal bore of the outer sleeve sub;

wherein the isolation sleeve and the nut are engaged with each other such that rotation of the nut with respect to the isolation sleeve moves the isolation sleeve axially within the internal bore of the outer sleeve sub.

10. The system of claim 9, further comprising:

the connector to couple to the well equipment, the connector comprising a respective internal bore; and wherein the outer sleeve sub is positioned at least partially within the internal bore of the connector, the isolation sleeve axially movable with respect to the internal bore of the connector.

11. The system of claim 9, further comprising:

a second seal to engage the outer sleeve sub and the isolation sleeve; and a seal support positioned adjacent the second seal to support the second seal between the outer sleeve sub and the isolation sleeve;

wherein the second seal comprises a metal end cap seal.

12. The system of claim 9, wherein the isolation sleeve comprises a proximal end positioned within the outer sleeve sub and a distal end extending out from the outer sleeve sub, and wherein the seal is positioned on the distal end of the isolation sleeve.

13. The system of claim 1, wherein the connector is configured to contact and engage a radially-outer surface of an annular housing of the well equipment to couple the connector to the well equipment, and the isolation sleeve is configured to be positioned within a respective bore of the well equipment that is defined by a radially-inner surface of the annular housing of the well equipment and to enable the seal to engage the radially-inner surface of the annular housing of the well equipment.

* * * * *